United States Patent [19]

Kennedy et al.

[11] Patent Number: 4,478,535

[45] Date of Patent: Oct. 23, 1984

[54] MINE STOPPING WITH MAN DOOR AND DOOR FRAME ASSEMBLY

[76] Inventors: John M. Kennedy; William R. Kennedy, both of P.O. Box 38, Taylorville, Ill. 62568

[21] Appl. No.: 453,822

[22] Filed: Dec. 27, 1982

[51] Int. Cl.[3] ..... E21F 1/14

[52] U.S. Cl. ..... 405/132; 52/204; 405/144

[58] Field of Search ..... 405/132, 144, 288; 49/402; 52/204, 573

[56] References Cited

U.S. PATENT DOCUMENTS 4,294,563 10/1981 Kilburn ..... 405/132

*Primary Examiner*—David H. Corbin

*Attorney, Agent, or Firm*—Senniger, Powers, Leavitt and Roedel

[57] ABSTRACT

A mine stopping having a man door and door frame assembly in which the mine stopping comprises a plurality of elongate extensible and contractible panels extending vertically in side-by-side relation from the floor to the roof of a passageway in a mine. Each panel comprises a first elongate member constituting the lower member of the panel and a second elongate member constituting the upper member of the panel. Each of the panel members has a web and flanges at opposite sides of the web, one of the members having a telescoping sliding fit in the other. The assembly comprises a rectangular frame having top, bottom and side channel members, the door being hinged to one of these. The frame is mounted in an opening in the mine stopping without any fastening means between the frame and stopping panels thereby maintaining the extensibility and contractibility of the panels.

2 Claims, 3 Drawing Figures

MINE STOPPING WITH MAN DOOR AND DOOR FRAME ASSEMBLY

BACKGROUND OF THE INVENTION

This invention relates to a mine stopping having a man door and a door frame assembly therein and, more particularly, to a mine stopping comprising a plurality of extensible and contractible metal panels and a man door and door frame assembly installed in a man door opening in the mine stopping.

So-called mine "stoppings" are widely used in mines to stop off the flow of air in passages in the mines, a stopping generally being installed at the entrance of a passage to block the flow of air therethrough. One type of mine stopping that is widely used is the type made of extensible and contractible panels. It is often desired that such stoppings be provided with a door, which is referred to as a "man door", for occasional access to the blocked off passage. However, a problem has been encountered in providing a door for a stopping comprising elongate extensible and contractible panels in that the use of fastening means, such as bolts or screws, for securing the door frame in place interferes with the extensibility and contractibility of the panels.

SUMMARY OF THE INVENTION

Among the several objects of this invention may be noted the provision of a mine stopping made up of contractible and extensible panels with a man door and a door frame assembly which does not interfere with the extensibility and contractibility of the panels comprising the mine stopping; and the provision of such an assembly which is of simple and economical construction.

In general, the invention involves a mine stopping having a man door and frame assembly therein, the stopping comprising a plurality of elongate extensible panels extending vertically in side-by-side relation from the floor to the roof of a passageway in a mine. Each panel comprises a first elongate member constituting a lower member of the panel and a second elongate member constituting an upper member of the panel. Each of the panel members is a sheet metal member of channel shape in cross section having a web and flanges at opposite sides of the web, one of the members having a telescoping sliding fit in the other with the webs of the members in engagement, the one member constituting the inner member and the other constituting the outer member of the panel. A plurality of the panels are installed in the passageway with the side flanges of the outer member generally in engagement. The frame is a rectangular frame having a top, bottom and side channel members. The frame is adapted to be mounted in an opening in the mine stopping. Each of the channel members has a web, a rear flange and a forward flange, the flanges of the top channel member extending upwardly, the flanges of the bottom channel member extending downwardly and the flanges of the side channel members extending outwardly. Hinge means hingedly mounts the door on the frame to swing on an axis between a closed position engaging a face of the frame all around the frame and an open position swung away from the frame. The stopping includes a plurality of said panels above the frame having their lower ends received in the top channel, a plurality of said panels below the frame having their upper ends received in the bottom channel, and a plurality of panels at the sides of the frame including a pair of panels received in the side channels of the frame, without any fastening means between the frame and the panels thereby maintaining the extensibility and contractibility of the panels.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3:
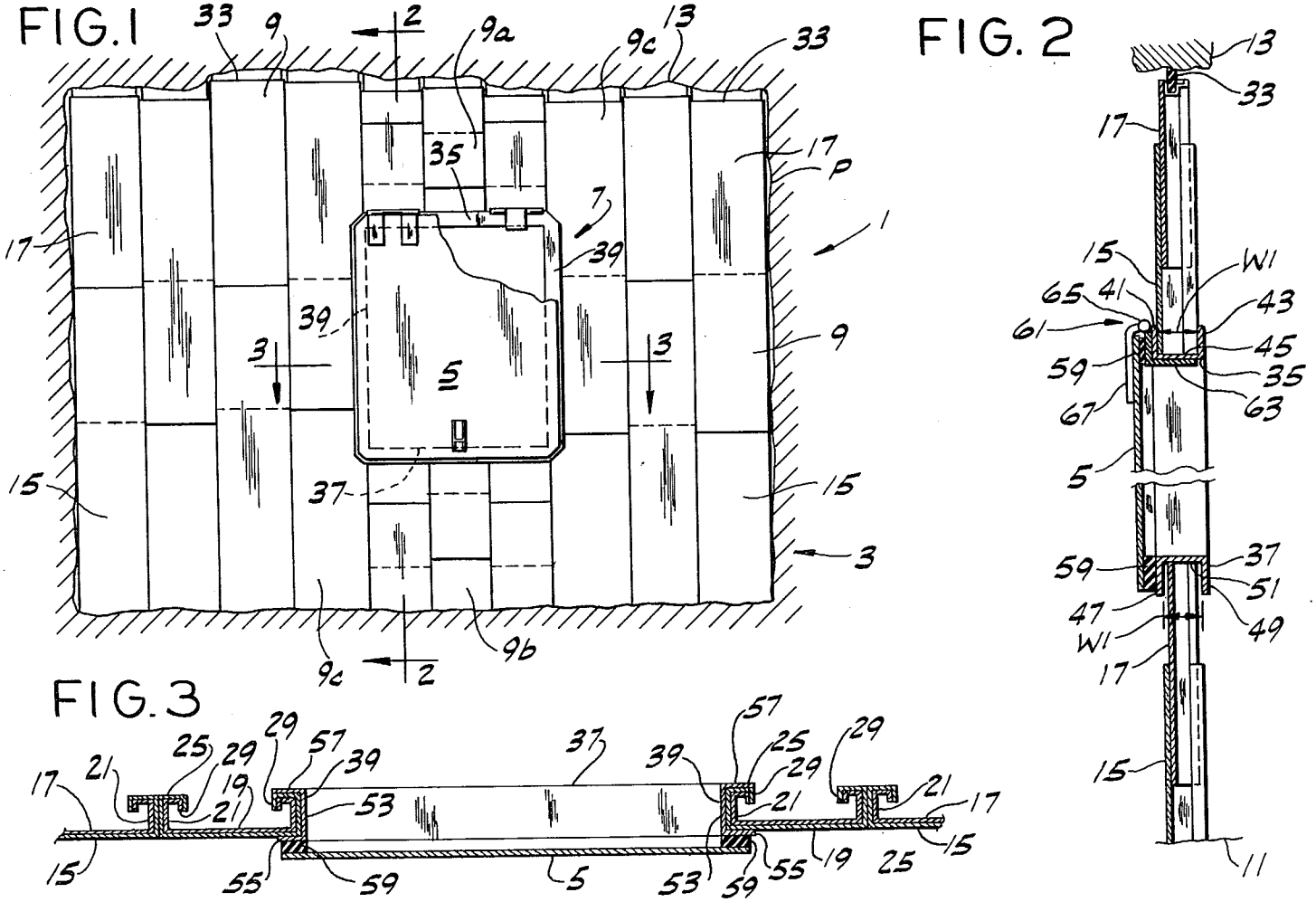
FIG. 1 is a front elevation of a mine stopping in a passageway in a mine with a man door and door frame assembly in the stopping.
FIG. 2 is an enlarged vertical section on line 2—2 of FIG. 1.
FIG. 3 is an enlarged horizontal section on line 3—3 of FIG. 1.

Referring to the drawings, there is generally indicated at 1 a mine stopping 3 having a man door and frame assembly comprising a door 5 and frame assembly 7 installed in a passageway P in a mine in accordance with this invention. The stopping comprises a plurality of elongate panels 9 extending vertically in side-by-side relation from the floor 11 to the roof 13 of a passageway P. Each of the panels 9 comprises a first elongate member 15 constituting a lower member of the panel 9 adapted for engagement of its lower end with the floor 11 of the passageway P as shown in FIGS. 1 and 2, and a second elongate member 17 constituting an upper member of the panel 9 adapted for engagement of its upper end with the roof 13 of the passageway P. Each of the panel members 15 and 17 is a sheet metal member of channel shape in cross section having a web 19 and flanges 21 at opposite sides of the web (see FIG. 3). Each flange 21 has an inturned portion 25 at its outer edge extending generally parallel to the web 19 and a lip 29 at the inner edge of the inturned portion extending toward the web 19. The upper panel member 17 is shown in FIGS. 2 and 3 as having a telescoping fit in the respective lower panel member 15, the webs 19 of the members being in sliding engagement. This could be reversed—the lower panel member may have a telescoping sliding fit in the upper panel member. The upper panel member 17 constitutes the inner member and the lower panel member 15 constitutes the outer member of the panel 9. A plurality of the panels are installed in the passageway P to form the stopping with the side flanges 21 of one panel member in engagement with the side flanges 21 of the adjacent panel member (see FIG. 3). A sealing member 33, preferably comprising a block of expanded polystyrene (other suitable materials may be used), is pocketed at the top of the panel member and extends up out of the upper end of the upper member 17 for engagement with the roof 13 of the passageway P to provide a resilient seal.

The frame 7 is a rectangular frame having a top, bottom and side channel members 35, 37 and 39, respectively. The frame is adapted to be mounted in a man-door opening in the stopping 3. The top of the frame, as shown in FIG. 2, is constituted by a channel member 35 with a width W1 between the upwardly extending forward and rearward flanges 41 and 43 of the channel member slightly greater than the thickness of the outer panel member 15 of which the stopping is constituted.

The web of the top channel member 35 is designated 45. This member opens upwardly. The flange 41 is the forward flange of the top channel member 35 at the door face of the frame.

The bottom of the frame comprises a metal channel member 37 with a width W1, the same as the width of the top channel member 35, between the downwardly extending forward and rearward flanges 47 and 49 of the channel member 37 slightly greater than the thickness of the outer panel member 15 of which the stopping is constituted. The web of the bottom channel member is designated 51. This member opens downwardly. The flange 47 is the forward flange of the bottom channel member 37 at the door face of the frame.

Each side 39 of the frame is of channel shape in cross section, having a web 53 and laterally outwardly extending forward and rearward flanges 55 and 57. The flange 55 is the forward flange of the side channel members 39 at the door face of the frame.

The door 5 is formed of metal plate with a gasket 59 engageable with the front flanges 41, 47 and 55 of the top, bottom and side channels 35, 37 and 39 of the frame. The door 5 has hinge means 61 at an edge of the frame for hingedly mounting the door 5 to swing on an axis between a closed position engaging the front face of the frame all around the frame and an open position swung away from the frame. The hinge means 61 comprises an L-shaped mounting bracket 63 secured as by welding to the front face 41 and underside of the web 45 of the top channel member 35, a hinge pin 65 and a hinge plate 67 mounted on the front face of the man door 5.

The stopping 3 includes a plurality of relatively short panels **9*a* above the frame 7 having their lower ends received in the top channel 35 and a plurality of relatively short panels 9*b* below the frame 7 having their upper ends received in the bottom channel 37 (see FIGS. 1 and 2). Panels 9*c* adjacent the sides of the frame 7 are full-length panels received in the side channels 39 of the frame (see FIGS. 1 and 3) with the flange 21, web 19 and inturned portion 25 of the panel in sliding engagement with the web 53 and the laterally outwardly extending forward and rearward flanges 55 and 57 of the side channels 39. The hinge means 61 is secured to one of the channel members 35, 37, or 39 so that the respective panel 9*a*, 9*b*, or 9*c*** can be received in the channel member without interference.

No fasteners (e.g., screws, bolts) are used in installing the door frame 7 in place in the stopping. No fasteners are used at the lower end of panels **9*a*, or at the upper ends of panels 9*b*, or at the sides. Panels 9*c* at the sides are received in the side channel members 39** without any fasteners extending through these panels so that there is nothing to interfere with their extensibility and contractibility.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mine stopping having a man door and door frame assembly therein, said stopping comprising:

a plurality of elongate extensible panels extending vertically in side-by-side relation from the floor to the roof of a passageway in a mine, each panel comprising a first elongate member constituting a lower member of the panel and a second elongate member constituting an upper member of the panel, each of said panel members being a sheet metal member of channel shape in cross section having a web and flanges at opposite sides of the web, one of said members having a telescoping sliding fit in the other with the webs of the members in engagement, the one member constituting the inner member and the other constituting the outer member of the panel, a plurality of the panels being installed in the passageway with the side flanges of the outer members generally in engagement, said frame being a rectangular frame having a top, bottom and side channel members, said frame being adapted to be mounted in an opening in the mine stopping, each of said channel members having a web, a rear flange and a forward flange, the flanges of the top channel member extending upwardly, the flanges of the bottom channel member extending downwardly, the flanges of the side channel members extending outwardly, hinge means hingedly mounting the door on the frame to swing on an axis between a closed position engaging a face of the frame all around the frame and an open position swung away from the frame, said stopping comprising a plurality of said panels above the frame having their lower ends received in the top channel, a plurality of said panels below the frame having their upper ends received in the bottom channel, and a plurality of said panels at the sides of the frame including a pair of panels received in the side channels of the frame, said stopping being free of fastening means between the frame and the panels thereby maintaining the extensibility and contractability of the panels.

2. A mine stopping as set forth in claim 1 wherein the hinge means for the door is mounted on one of the channel members without interfering with the reception of the panels in the channel member.

* * * * *